US006295749B1

(12) United States Patent
Lin

(10) Patent No.: US 6,295,749 B1
(45) Date of Patent: Oct. 2, 2001

(54) ORNAMENTAL DISPLAY TOY

(76) Inventor: Yung Chang Lin, No. 10, Lane 105, Pao Tsing Street, Taipei (TW)

( * ) Notice: Subject to any disclaimer, the term of this patent is extended or adjusted under 35 U.S.C. 154(b) by 0 days.

(21) Appl. No.: 09/400,197

(22) Filed: Sep. 21, 1999

(51) Int. Cl.[7] ..... G09F 19/08; F21V 33/00
(52) U.S. Cl. ..... 40/406; 446/136
(58) Field of Search ..... 40/406, 426; 434/126, 434/217; 446/267, 129, 131, 133, 134

(56) References Cited

U.S. PATENT DOCUMENTS 4,490,931 * 1/1985 Fleemin ..... 40/406
5,018,288 * 5/1991 Yang ..... 40/406
5,272,604 * 12/1993 Lin ..... 40/406
5,301,444 * 4/1994 Horiuchi ..... 40/406
5,435,086 * 7/1995 Huang ..... 40/426
5,458,012 * 10/1995 Liu ..... 40/409 X
5,463,826 * 11/1995 Horiuchi ..... 40/426
5,620,353 * 4/1997 Lai ..... 40/411 X
5,743,780 * 4/1998 Liu ..... 40/406 X
5,915,853 * 6/1999 Guilin ..... 40/414

* cited by examiner

*Primary Examiner*—Cassandra H. Davis
(74) *Attorney, Agent, or Firm*—Dougherty & Troxell

(57) ABSTRACT

An ornamental display toy, which includes a transparent container supported on a base and filled with a chemical liquid, a magnetic stirrer mounted in the container and driven to stir up the liquid, a motor drive formed of a motor and a transmission mechanism and controlled by a control circuit to turn the magnetic stirrer on its own axis and to revolve the magnetic stirrer around the longitudinal central axis of the container, causing a variable whirlpool to be produced in the liquid inside the container.

11 Claims, 3 Drawing Sheets

ORNAMENTAL DISPLAY TOY

BACKGROUND OF THE INVENTION

The present invention relates to an ornamental display toy, and more particularly to such an ornamental display toy, which uses a motor drive to rotate a magnetic stirrer on its own axis in a chemical liquid inside a transparent container, and to revolve the magnetic stirrer around the longitudinal central axis of the container, causing a variable whirlpool to be produced in the chemical liquid in the container.

FIG. 1 shows an ornamental display toy according to the prior art. This structure of ornamental display toy comprises a transparent container holding two liquids of different specific gravity, a centrifugal vane wheel mounted in the container, and a partition board provided inside the container above the vane wheel. The partition board has a suction hole aimed at the vane wheel, and a plurality of exhaust holes around the border. When the vane wheel is rotated, the liquid of smaller specific gravity is spirally drawn downwards, causing a tornado to be produced in the container. Because the vane wheel is fixedly mounted inside the container at the bottom, it can cause only one fixed pattern of whirlpool. When changing the revolving speed of the vane wheel, the size of the whirlpool is relatively changed, however the pattern of the whirlpool remains unchanged.

SUMMARY OF THE INVENTION

It is the main object of the present invention to provide an ornamental display toy, which uses a simple mechanical design to achieve a variable whirlpool effect.

According to one aspect of the present invention, the ornamental display toy comprises a transparent container supported on a base and filled with a chemical liquid, a magnetic stirrer mounted in the container and driven to stir up the liquid, a motor drive formed of a motor and a transmission mechanism and controlled by a control circuit to turn the magnetic stirrer on its own axis and to revolve the magnetic stirrer around the longitudinal central axis of the container, causing a variable whirlpool to be produced in the liquid inside the container.

According to another aspect of the present invention, the transmission mechanism can be a gear transmission mechanism, friction transmission mechanism, or belt transmission mechanism.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
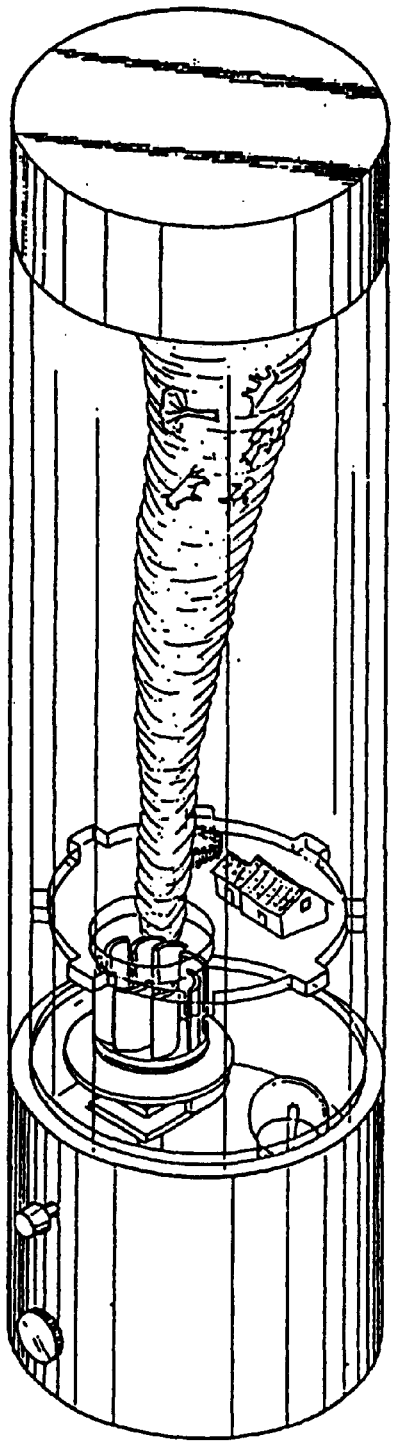
(PRIOR ART) FIG. 1
FIG. 1 illustrates an ornamental display toy according to the prior art.
Figure 2:
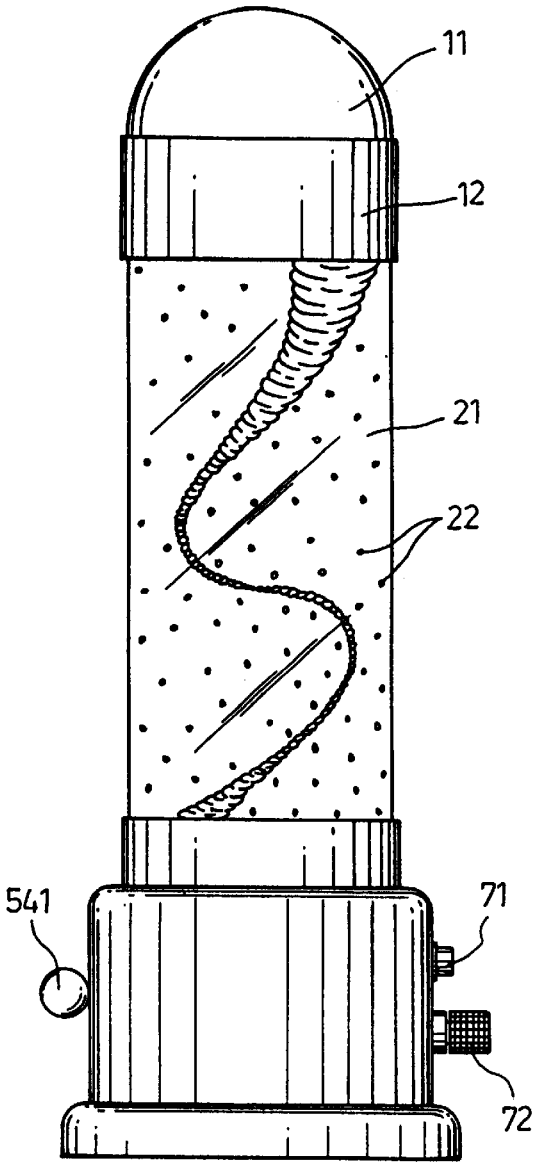
FIG. 2 is a perspective view of an ornamental display toy according to a first embodiment of the present invention.
Figure 3:
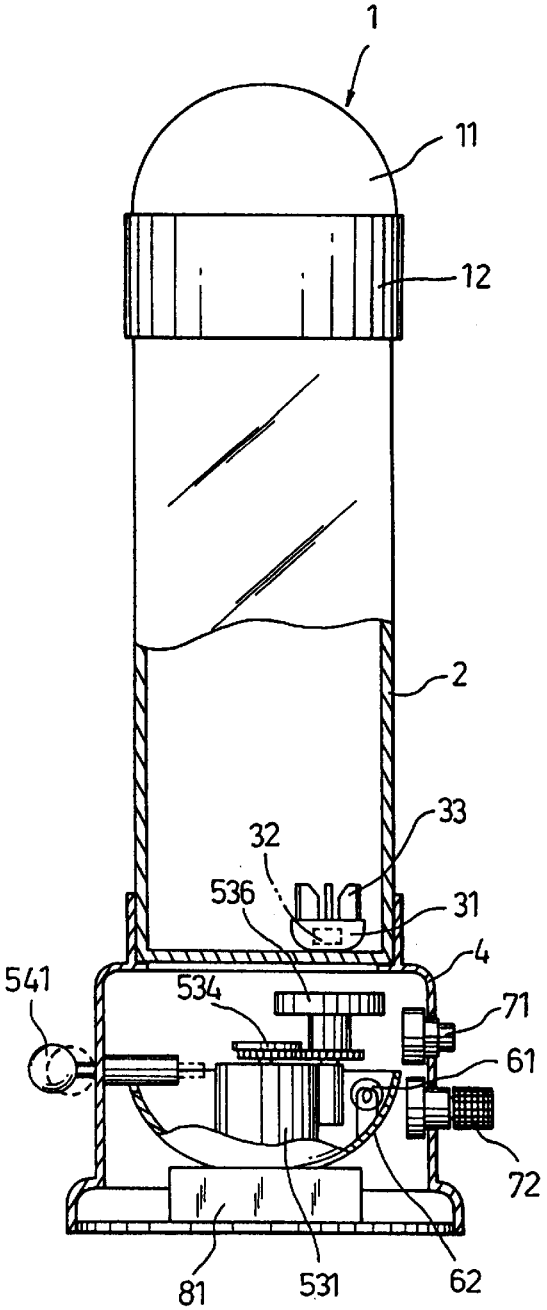
FIG. 3 is a sectional view of the ornamental display toy according to the first embodiment of the present invention.
Figure 4:
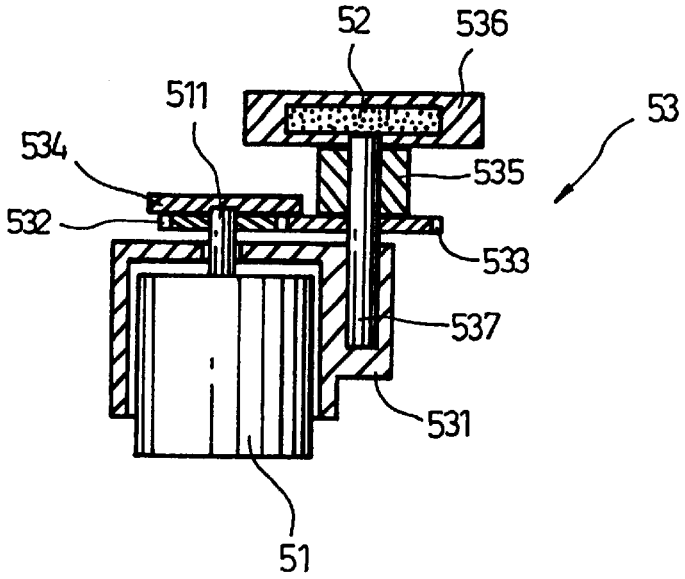
FIG. 4 is a sectional view of a transmission mechanism for the ornamental display toy of the first embodiment of the present invention.

Referring to Figures from 2 through 4, an ornamental display toy is shown according to a first embodiment of the present invention, comprising a hollow base 4, a transparent container 2 supported on the base 4, a chemical fluid 21 filled in the container 2, a plurality of ornamental plastic grains 22 put in the chemical fluid 21, a stirrer 31 mounted inside the container 2 at the bottom, and a cover 1 covered on the container 2 at the top. The stirrer 31 has a magnet 32 mounted inside the rounded bottom thereof, and a plurality of upright stirring blades 33 at the top. The cover 1 is comprised of a semi-transparent plastic dome 11, which is filled up with a filling, and an opaque ring 12, which secures the dome 11 to the container 2. Inside the hollow base 4, there is provided a power drive, a lighting unit, a control circuit, and a power supply unit.

The aforesaid power drive is comprised of a motor 51, a magnet 52, and a transmission mechanism 53. The transmission mechanism 53 comprises a shell 531 covered over the motor 51, a driving gear 532 coupled to the output shaft 511 of the motor 51, a damper 534 provided at the top side of the driving gear 532, a driven gear 533 meshed with the driven gear 532, the driven gear 533 having a gear shaft 537 supported in a hole at the shell 531, a transmission shaft 535 fastened to the gear shaft 537 of the driven gear 533, and a rotary wheel 536 fixedly connected to the transmission shaft 535 at the top. The magnet 52 of the power drive is mounted in the rotary wheel 536 at the center.

The aforesaid lighting unit is comprised of a lamp bulb 61, and a semispherical reflector 62.

The aforesaid control circuit is comprised of a switch 71, and a variable resistor 72. The switch 71 and the variable resistor 72 may be synthesized into an integrated device.

The aforesaid power supply unit is comprised of a battery holder 81 holding a battery to provide the necessary working voltage, and an AC adapter socket (not shown) for obtaining the necessary working voltage from city power supply through an adapter.

The ornamental display toy further comprises a damping mechanism 54 is comprised of a stop bolt 541 for stopping the revolution of the transmission mechanism 53, the magnet 52 and the stirrer 3 around the longitudinal central axis of the ornamental display toy, so as to produce a tornado in the container 2. The user can operate the stop bolt 541 to produce a water dance effect.

The transmission mechanism drives the magnet 52 to rotate on its own axis, and also drives the magnet 52, the rotary wheel 536 and the transmission shaft 535 to revolve around the longitudinal central axis of the ornamental display toy. When the motor 51 is started, the output shaft 511 of the motor 51 rotates the driving gear 532. The damper 534 and the driving gear 532 are fixedly fastened together. The driven gear 533 is driven by the driving gear 532 to rotate the transmission shaft 535, the rotary wheel 536 and the magnet 52 in the rotary wheel 536. The shell 531 is covered over the motor 51 and can be freely rotated, having a hole (not shown) for the passing of the output shaft 511 of the motor 51.

Before starting, the magnet 32 in the stirrer 31 is attracted by the magnet 52 in the rotary wheel 536, thereby causing the stirrer 31 to be retained to the bottom wall of the container 2 in place. When started, the revolving speed of the motor 51 is regulated through the control circuit, and the stirrer 31 is forced to rotate on its own axis. The friction force and centrifugal force between the stirrer 31 and the bottom wall of the container 2 enable the stirrer 31 to move along the bottom wall of the container 2. Because the magnet and the gears of the transmission mechanism of the power drive can be turned about the longitudinal central axis of the container, the movement of the stirrer 31 carries the magnet 32 to move around the longitudinal central axis of the container. The revolution of the stirrer 31 on its own axis and around the longitudinal central axis of the container 32 causes a whirlpool and an air column to be produced in the container 2.

Because the stirrer 31 is driven to rotate by a magnetic force, the container 2 and the hollow base 4 can be separated from each other, it is not necessary to provide a hole at the bottom wall of the container for the passing of a transmission shaft. This special feature eliminates the arrangement of a water sealing structure around the transmission shaft; therefore the whole structure of the ornamental display toy can be simplified. Further, because the stirrer is driven to rotate on its own axis, and to revolve around the longitudinal central axis of the container, a variable whirlpool can be produced in the transparent container 2.

Figure 5:
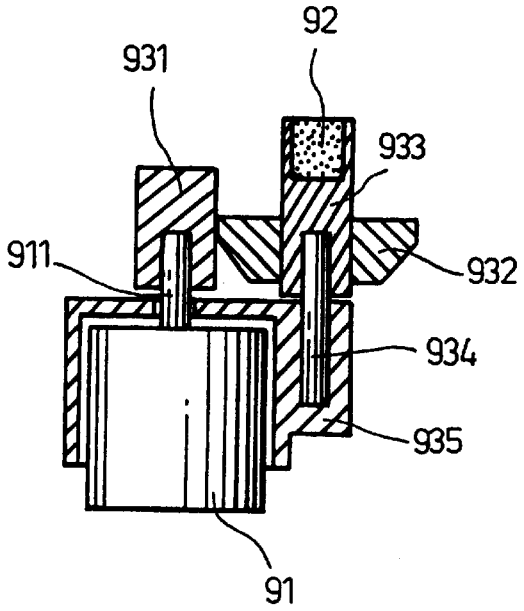
FIG. 5 is a sectional view of a transmission mechanism for an ornamental display toy according to a second embodiment of the present invention.

FIG. 5 shows an alternate form of the transmission mechanism for the power drive. According to this alternate form, the transmission mechanism comprises a motor 91, a shell 935 covered over the motor 91, a first friction wheel 931 fixedly fastened to the output shaft 911 of the motor 91, a transmission shaft 933 mounted on a shaft 934 being supported in a hole at the shell 935, a second friction wheel 932 fixedly mounted on the transmission shaft 933. The magnet 92 of the power drive is mounted in the transmission shaft 933.

It is to be understood that the drawings are designed for purposes of illustration only, and are not intended for use as a definition of the limits and scope of the invention disclosed. For example, the lighting unit can be arranged to emit light upwardly through the container 2, and any of a variety of reflector means may be used to reflect light from the bulb of the lighting unit toward the liquid in the container 2. An AC adapter may be directly installed in the hollow base 4 to convert city power supply into the desired working voltage. Further, a belt transmission mechanism may be used instead of the aforesaid two different embodiments.

What the invention claimed is:

1. An ornamental display toy having a base, a transparent container having a central axis supported on the base and filled with a liquid, the transparent container having a bottom wall, the display toy comprising:

a) a power source located in the base, the power source comprising an electric motor;

b) a transmission mechanism located in the base and driven by the power source, the transmission mechanism including a rotatable first magnet located eccentric to the central axis of the container, the transmission mechanism rotating the first magnet about its axis while revolving the first magnet about the central axis of the transparent container, the transmission mechanism comprising:

i) a rotatable output shaft extending from the electric motor;

ii) a rotatable shell at least partially enclosing the electric motor, the output shaft extending through the shell;

iii) a driving gear mounted on the output shaft so as to rotate therewith;

iv) a gear shaft mounted on and extending from the shell, the first magnet being mounted on the gear shaft; and, v) a driven gear mounted on the gear shaft and engaged with the driving gear; and, c) a stirrer located within the transparent container, the stirrer having a rounded bottom portion in movable contact with the bottom wall of the container, a second magnet located in the rounded bottom portion and at least one stirring blade extending from the rounded bottom portion, whereby magnetic forces between the first and second magnets cause the stirrer to rotate about its own axis and to revolve about the central axis of the transparent container.

2. The ornamental display toy of claim 1 wherein the stirrer comprises a plurality of stirring blades.

3. The ornamental display toy of claim 1 further comprising a lighting unit located in the base.

4. The ornamental display toy of claim 3 wherein the lighting unit includes a light bulb and a hemispherical reflector.

5. The ornamental display toy of claim 1 further comprising a control circuit including a control switch and a variable resistor for regulating a speed of the electric motor.

6. The ornamental display toy of claim 1 further comprising a rotary wheel mounted on the gear shaft, the rotary wheel having the first magnet therein.

7. An ornamental display toy having a base, a transparent container having a central axis supported on the base and filled with a liquid, the transparent container having a bottom wall, the display toy comprising:

a) a power source located in the base, the power source comprising an electric motor;

b) a transmission mechanism located in the base and driven by the power source, the transmission mechanism including a rotatable first magnet located eccentric to the central axis of the container, the transmission mechanism rotating the first magnet about its axis while revolving the first magnet about the central axis of the transparent container, the transmission mechanism comprising:

i) a rotatable output shaft extending from the electric motor;

ii) a rotatable shell at least partially enclosing the electric motor, the output shaft extending through the shell;

iii) a first friction wheel mounted on the output shaft;

iv) a shaft mounted on and extending from the shell, the first mag net being mounted on the shaft; and, v) a second friction wheel mounted on the shaft and engaging the first friction wheel; and, c) a stirrer located within the transparent container, the stirrer having a rounded bottom portion in movable contact with the bottom wall of the container, a second magnet located in the rounded bottom portion and at least one stirring blade extending from the rounded bottom portion, whereby magnetic forces between the first and second magnets cause the stirrer to rotate about its own axis and to revolve about the central axis of the transparent container.

8. The ornamental display toy of claim 7 wherein the stirrer comprises a plurality of stirring blades.

9. The ornamental display toy of claim 7 further comprising a lighting, unit located in the base.

10. The ornamental display toy of claim 9 wherein the lighting unit includes a light bulb and a hemispherical reflector.

11. The ornamental display toy of claim 7 further comprising a control circuit including a control switch and a variable resistor for regulating a speed of the electric motor.

* * * * *